US010170866B2

(12) United States Patent
Simmonds

(10) Patent No.: US 10,170,866 B2
(45) Date of Patent: Jan. 1, 2019

(54) SHIELDED ELECTRIC CONNECTOR

(71) Applicant: Simon Simmonds, San Diego, CA (US)

(72) Inventor: Simon Simmonds, San Diego, CA (US)

( * ) Notice: Subject to any disclaimer, the term of this patent is extended or adjusted under 35 U.S.C. 154(b) by 0 days.

(21) Appl. No.: 15/589,604

(22) Filed: May 8, 2017

(65) Prior Publication Data

US 2018/0019550 A1 Jan. 18, 2018

Related U.S. Application Data

(60) Provisional application No. 62/333,582, filed on May 9, 2016.

(51) Int. Cl.

| | |
|---|---|
| ***H01R 9/03*** | (2006.01) |
| ***H01R 13/6582*** | (2011.01) |
| ***H01R 9/05*** | (2006.01) |
| ***H01R 13/6593*** | (2011.01) |
| ***H01R 13/703*** | (2006.01) |
| *H01R 13/74* | (2006.01) |
| *H01R 103/00* | (2006.01) |

(52) U.S. Cl.

CPC ..... *H01R 13/6582* (2013.01); *H01R 9/032* (2013.01); *H01R 9/0521* (2013.01); *H01R 9/0524* (2013.01); *H01R 9/0527* (2013.01); *H01R 13/6593* (2013.01); *H01R 13/703* (2013.01); *H01R 13/74* (2013.01); *H01R 2103/00* (2013.01)

(58) Field of Classification Search

CPC .. H01R 13/6582; H01R 13/53; H01R 13/703; H01R 13/74; H01R 13/6593; H01R 9/032; H01R 9/0521; H01B 11/008; H01B 11/1895; H01B 11/1813; H01B 7/202; H01B 7/288

USPC ..... 439/607.58

See application file for complete search history.

(56) References Cited

U.S. PATENT DOCUMENTS

| | | | | |
|---|---|---|---|---|
| 3,651,244 A * | 3/1972 | Silver | H01B 9/022 | 156/54 |
| 5,527,995 A * | 6/1996 | Lasky | H01B 7/202 | 174/102 D |
| 5,646,370 A * | 7/1997 | Perkins | H01R 13/53 | 174/51 |
| 6,384,337 B1 * | 5/2002 | Drum | H01B 11/1813 | 174/102 R |
| 7,053,309 B2 * | 5/2006 | Efraimsson | H01B 7/288 | 174/102 SC |
| 7,522,794 B2 * | 4/2009 | Martin, Jr. | G02B 6/4494 | 385/100 |
| 7,737,362 B2 * | 6/2010 | Ogura | H01B 11/1895 | 174/102 R |
| 7,763,805 B2 * | 7/2010 | Stutzman | H01B 11/1008 | 174/113 C |

* cited by examiner

*Primary Examiner* — Jean D Duverne

(74) *Attorney, Agent, or Firm* — Donn K. Harms

(57) ABSTRACT

An electrical connector system having rubber molded single pin high power conductors, for both the male and female electrical connectors positioned on the ends of high power electric connection cables. Configuration of both the male and female connectors enhances shielding at the connection point of conductors at distal ends of the electric when mating in an electric connection. The shielded connections limit electronic noise from RF or EMF which may be transmitted to equipment proximate to a shielded connection.

14 Claims, 3 Drawing Sheets

SHIELDED ELECTRIC CONNECTOR

This application claims the benefit of Provisional Application No. 62/333,582 filed on May 9, 2016.

BACKGROUND OF THE INVENTION

1. Field of the Invention

The present invention relates generally to connectors for employment in the communication of power in electrical systems. More particularly, the invention relates to tri-functional shielded connectors employable for use with either a single conductor cable or multiconductor cable, such high power cables employed in oil drilling which are grounded. The system herein can also be configured in a relay-compatible mode for an additional level of safety.

2. Prior Art

Single-pole connectors positioned at the ends of electric cables used to communicate high power requirements are used in a variety of industrial settings such as oil and other drilling platforms, stage power requirements at concerts, and equipment requiring high power, such as carnival rides and the like. Because of the requirements of the electric motors and other equipment to which these power lines communicate electric power, the connectors positioned on the opposing ends of transmission cables must be rated for extremely high voltage and current. As in all instances where electrical power is being transmitted, safety for users of such equipment is paramount.

Equipment using such high amperage and high voltage power generally includes DC and more modernly AC electric motors. DC motors have been employed, for example, in the drilling industry because of the ability to control speed and direction of the rotation of the motor easily. Varying the rotation speed of such motors is generally accomplished by varying the voltage communicated to them. Additionally, by reversing the polarity of the electric current supplied to such DC motors, they will reverse direction. As a consequence, the control of the rotational speed of DC motors is a fairly simple matter of varying the current voltage. Reversing direction simply requires reversing the DC current delivered. Braking can also be accomplished by delivering a reversal of current polarity if desired. A background of the various conventional cable configurations and uses can be found in U.S. Pat. Nos. 7,442,096, 7,749,007, 7,828,593, 8,157,594 and 8,574,006, for example, all of which are incorporated herein by this reference thereto.

In industries such as drilling, the employment of such DC motors over many decades has yielded the ability to control the speed of the drilling equipment, and the direction, by both varying the voltage and polarity of the power communicated to the DC motor being employed to power the drilling equipment. The oil industry is one area where high-power rotational motors with reliable speed control are used.

In the modern era of electronics, such as when drilling directionally rather than just vertically, it has become common to position sensors and other electronic components on the drilling rig, and in many instances proximate to the actual drilling component. Such sensors and electronic components are employed to monitor and communicate data concerning temperature, pressure, density of the formation and related resistance to rotation, and data concerning drilling which is of interest to the operator and engineers working on the rig.

Such data communicated during drilling allows the operators to vary and control the speed and torque communicated by the motor to the drilling components. Such adjustments, based on real time communicated data feedback is most important for running the drilling component, mud flow for removal of drilled cuttings, and for the ongoing operation of any tools or other sensing components positioned within the well.

As noted above, large DC current electric motors have been favored in the past due to their simplicity of operation, and in many instances DC motors are the power providers of choice. However, DC motors in the more recent era where directional drilling and hydraulic fracturing are being employed, while yielding the required torque and easy control, are being replaced by AC motors which are highly controllable for other factors and more energy efficient.

To that end, the employment of AC motors which operate with variable frequency drive (VFD) have become more widespread in drilling rigs and other industries which require the use of high torque rotational power. These AC electric motors which employ VFD are more efficient and use less electric energy than the standard DC motor technology. However, the introduction of such VFD AC motors has introduced a number of issues with regard to electrical power delivery.

To supply electricity to power such VFD AC motors, from conventional generators at the high voltages and current requirements of drilling, conventionally if AC current is used it must undergo conversion. First, the AC current must be converted to DC, and then the current transmitted to the motor at the distal end of the connected power supply lines is converted to AC with a varying frequency. At the desired current and voltage, the DC power is converted to simulated AC power using pulse width modulation to create the AC power employable by the motor.

The generation of AC power using such pulse width modulation techniques, by nature, requires high speed switching or reversal of the DC power to yield the pseudo AC power for the motor. This type of switching produces EMF fields which constantly collapse and reverse which can easily communicate noise in the system which can easily be transmitted to the cables running between the power supply and motor, and to areas proximate to the motor and supply cables.

As noted above, modernly, sensors positioned on or proximate to both the drilling component and the rig are extremely sensitive and constantly being employed to communicate real time data of the operators and engineers on the drilling rig. The electrical noise entering the system can cause significant problems with the sensors and the communication of data therefrom over transmission lines running through or adjacent the power cables. Such can also cause havoc with computer and monitoring equipment proximate to the rig.

Conventionally, the power cables employed on many drill sites and other venues using high power are single conductor coaxial cables with a center wire surrounded by a second conductor. The surrounding second conductor servers to communicate power to and from the motor, and to provide shielding for RF and EMF on the lengths of cable between the connectors at each end. The male connectors are surrounded by a flexible but durable insulating material and have a post which engages within a collar or collet of a female connector. The female connector may be metallic and engaged to a mount or may have a surrounding insulation formed of similar material to that of the male. However, these conventionally constructed cables are not well shielded at their respective male and female connectors, and thus can allow leakage of the noise from EMF or RF to escape to areas proximate to each connection therebetween whether employed with DC or AC power communication.

To limit communication of RF and related electronic noise into and out of the power system, in recent years the conventional cables employed for power transmission between the supply and the drilling component have included shielding. Such shielding has generally depended upon encasing the rubber or polymeric distal ends of the male and female fittings employed for such electric power, in metal casings.

However, with the male version of the fitting, the provided metal casing also communicates current to and from the motor over the long supply line. Thus, the metal casing is also a conductor and can expose the users to electric shock in some instances, such as when the surrounding conductor of the center conductor in a cable holds a charge much like a capacitor due to the long lengths such cables can reach. To help minimize this potential, the metallic casings have been painted or otherwise coated with a dielectric material to separate contact with the persons engaging them into female connectors from the metallic sheath or casing surrounding the fitting.

Such coatings may be easily scratched and thereby expose the user to contact with the electric conductor to which the metallic casing is connected. Further, other cables employed for electric power communication used on drilling and other sites, can be formed as noted above and lack this metallic casing or cover and are frequently in use on the same job site. Consequently, users must be careful in choosing which cables are employed for which rig to make sure the connector with shielding is employed where needed, and the connectors with rubber or polymeric or other flexible dielectric materials which lack any shielding at the connection point are used elsewhere. Such is a recipe for disaster in many instances where personnel are not familiar with electrical power issues and the proximity of sensors or delicate electronic equipment.

As a result, there is a continuing unmet need for an improved connector for employment upon electric power cables used in the communication of electrical power in electrical systems. Such connectors should provide industry standard rubber molded single pin high power connectors on the ends of high power connection cables which are employable for multiple configurations. Such a rubber molded male or female connector should provide improved shielding from electronic noise when used for power communication requiring shielded cable. Such a connector system should provide a conventional grounded cable for both shielded requirements and uses where shielding is not a major consideration. Further, such a connector system should be employable with relay (mini-switch) compatible cables where required.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art in high power cable connectors and achieves the above noted goals through the provision of a connector system providing rubber molded single pin high power connectors, for both the male and female connectors positioned on the ends of high power connection cables. Through a novel configuration, the disclosed system and method yields both the male and female connectors which provide significantly improved shielding at the connection point of the distal ends of cables to mating connectors, to prevent the propagation of noise from RF or EMF to equipment proximate to any such connection. At the same time, the connectors provide enhanced safety and ease of use by having a circumferential surface formed of rubber or a similar sturdy, but flexible, dielectric material. Thereby separating the metallic shielding component of the connectors from any possible contact with the hands or bodies of users handling them.

The connector system herein disclosed incorporates a copper or other conductive material to form a shield engaged with an epoxy insulated core into both the male and female cable connector bodies and with fixed female receptacle housings. An over molding process integrally bonds the copper or other conductive grounding ring providing the shielding, into the epoxy core and the surrounding rubber or similar dielectric material forming the exterior of the connector. This positively seals the conductive grounding ring into the dielectric material forming the connector assembly and prevents any risk of contact by a user. The over molding of the copper ring, within the epoxy positioned within the interior of the connector also seals against the ingress of moisture and other contaminants which might corrode the copper ring. Concurrently, this over molding construction provides mechanical rigidity and protection of the components of the connector.

The body forming the exterior of the male or female connector is formed of a sturdy dialectic material such as Hypalon rubber. This surrounding rubber exterior forms a secondary insulating layer over the primary insulator of the epoxy or other insulating ring surrounding the copper ring. The surrounding rubber or similar dielectric also provides mechanical and environmental protection.

Each connector has the insulated core which includes both the conductive ring and connected shielding extending to the circumference of the connected electric cable. The copper ring of the insulated core is preferably manufactured from a highly conductive material such as copper alloy C101 with a conductivity value of 100%, and then over molded with a layer of 1 mm of an epoxy resin system, or other combinations of insulations and conductive materials will work to provide an adequate level of insulation and current carrying capacity. The resulting insulated core provides electrical insulation in excess of 3000 Volts either AC or DC.

The resulting formed male or female connector is configured for connection with all conventional electrical connectors currently used for high electric power communication using a plug engageable with a receptacle or complimentary female connector and can, thus, be easily employed without modification to the installed base of such cables and receptacles which are typically mounted on or engaged with an end of a length of cable.

With respect to the above description, before explaining at least one preferred embodiment of the herein disclosed invention in detail, it is to be understood that the connector invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed connector device and method. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 1:
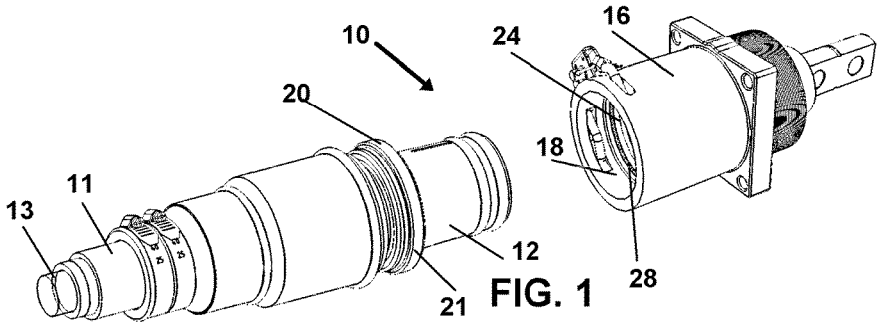
FIG. 1 shows an isometric view of a male connector aligned for operative engagement with a female receptacle of the system herein disclosed.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-8, wherein similar components are identified by like reference numerals, there is seen in FIG. 1 an isometric view of the connector system 10 herein, showing a first or male connector 12 positioned for operative engagement with a second or female connector 14 or female receptacle 16 of the system 10 herein disclosed. As can be seen, the first or male connector 12 is sized for operable removable engagement within an axial cavity 18 formed into the female connector 14 of FIG. 2, or the female receptacle 16 mode shown in FIG. 1, in a frictional engagement.

Figure 2:
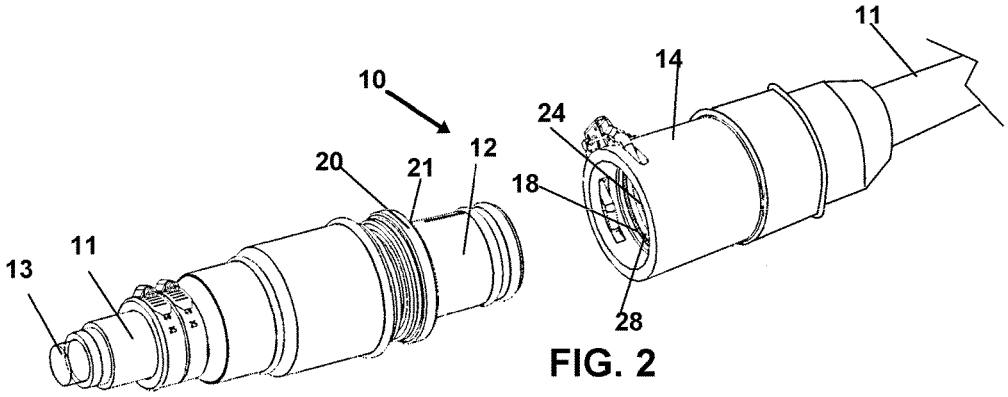
FIG. 2 shows the male connector of FIG. 1 aligned for engagement with a complimentary configured female connector of the system herein disclosed.

As can be seen in FIGS. 1-2, the ring 20 which is positioned within a dielectric material 17 such as an epoxy, surrounding the elongated ring 20, communicates at a first end through the dielectric material 17 to form an annular projecting ring 21 portion, having a substantially planar surface, adapted in circumference to electrically communicate in a frictional engagement with the interior surface of a mating ring 24 surrounding a portion of the axial cavity 18 of the female connector 14 or female receptacle 16.

Figure 3:
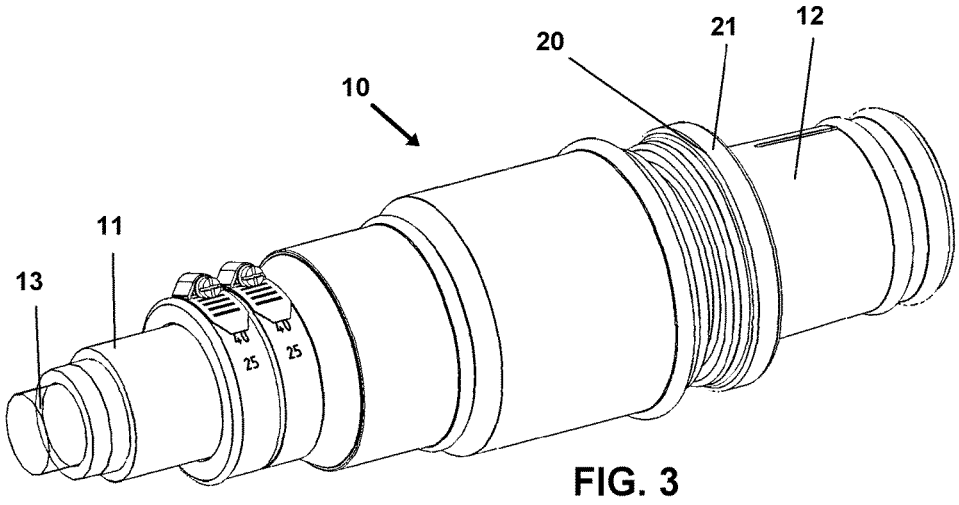
FIG. 3 shows a perspective view of the connectors of FIG. 2 in operative removable engagement.
Figure 4:
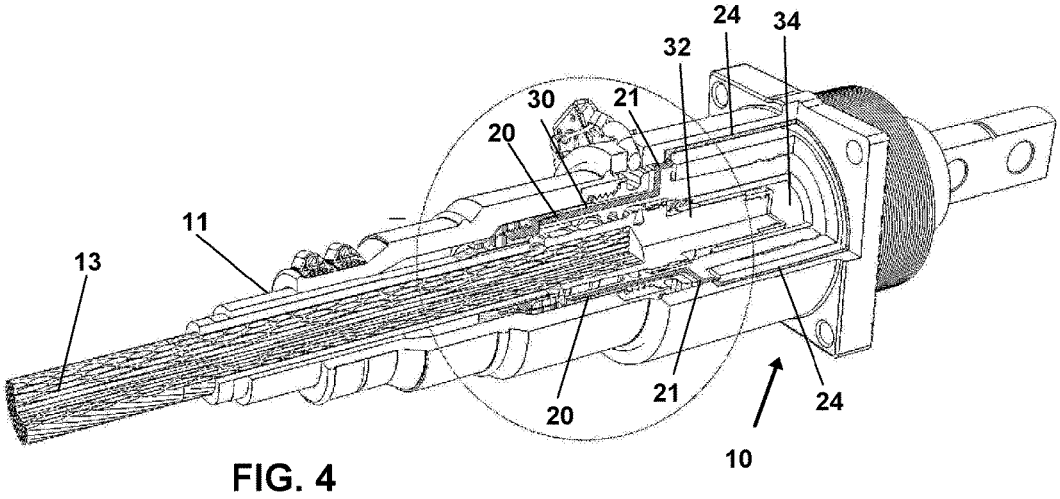
FIG. 4 shows the novel configuration of the dielectric encased copper ring of the system herein positioned on both a male connector and female receptacle.
Figure 5:
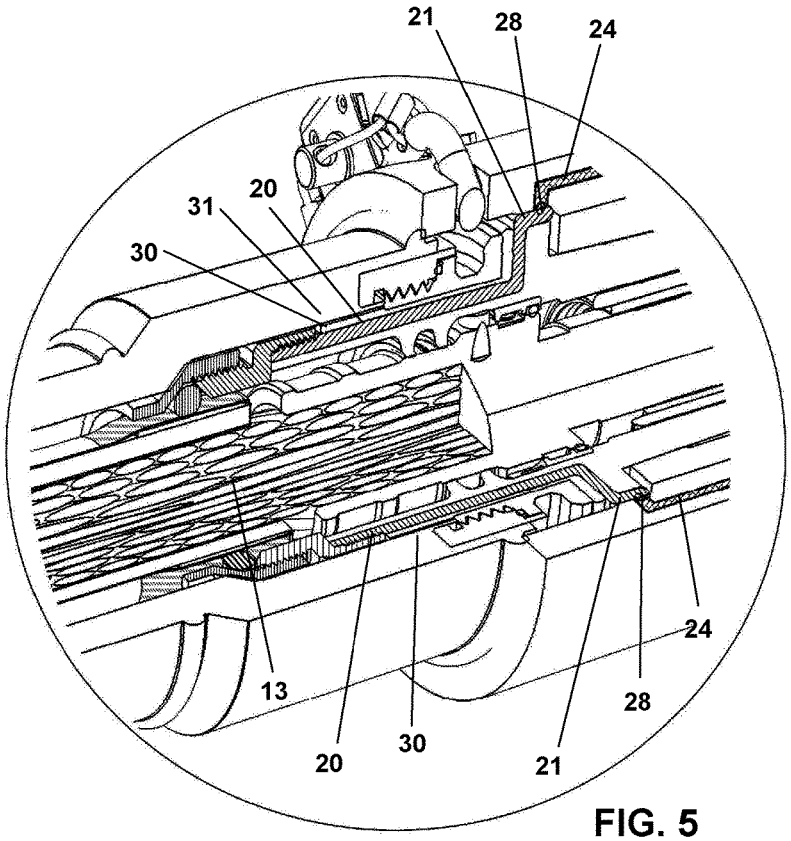
FIG. 5 shows an enlarged view of the circular area defined in FIG. 4.
Figure 6:
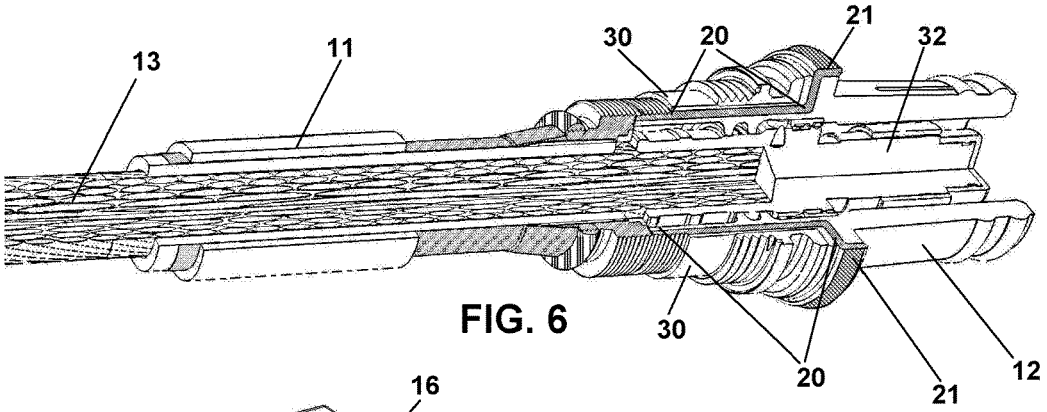
FIG. 6 depicts a sectional view of the male connector of FIG. 4.

To enhance this electrical connection between the projecting ring 21 portion of the ring 20 and the mating ring 24, when the male connector 12 is engaged with a female connector 14 or receptacle 16 such as shown in FIG. 3-5, a resilient conductor such as the depicted annular conductive spring 28 may be included. The resilient compressible conductors, such as the annular conductive spring 28, may be positioned to engage in a biased compressed sandwiched engagement in-between the annular projecting ring 21 portion of the ring 20, and the surface of the mating ring 24 surrounding a portion of the axial cavity 18.

As noted, FIGS. 4-5 shows a first or male connector 12 operatively engaged with a second or female connector 14 which would be engaged to one end of a cable 11 having a single conductor 13 running therethrough or as depicted, a female receptacle 16. The ring 20 is shown encased in a first dielectric material 30 such as the noted epoxy, which is surrounded by the second dielectric material 32 layer such as butyl rubber.

As can be seen in FIG. 5, with the first connector or male connector 12 operatively engaged within the axial cavity 18 of the female connector 14 or the female connector configured as a female receptacle 16, a total shielding is achieved which surrounds the connection of the pole connector 34 engaged to the conductor 13 within the cable 11 at its engagement with the cooperatively shaped pole receptor 34 of the second or female connector 14. This total shielding is provided by the electrically engaged ring 20 surrounding the first or male connector 12 and the mating ring 24 to which the annular projecting ring 21 contacts electrically either directly or using the preferred compressible conductor provided by the depicted annular spring 28. Thus, the system 10 provides cable connectors which may be employed where shielding from current generated noise is required, or since the connectors, as depicted, will work where such is not an issue, the cables 11 having the connectors herein may be employed in any current conventional electric system for high current motors without modification.

As noted above, FIG. 6 depicts a sectional view of the male connector of FIGS. 1-4 withdrawn from operative engagement with either a female connector 14 engaged on a cable 11, or a female receptacle 16 of the same configuration which is conventionally engaged to a fixed position such as on a power supply panel. As can be seen, the pin 32 is in electrical engagement to the cable 13 and the elongated ring 20 formed of a conductor like copper, extends from a second end adjacent the cable 13 to the projecting portion 21 which has a circumferential surface sized for sliding engagement within the mating ring 24 or in sandwiched engagement with the annular spring 28 or similar compressible conductor which will provide a biased electrical connection between the ring 20 and the mating ring 24.

Figure 7:
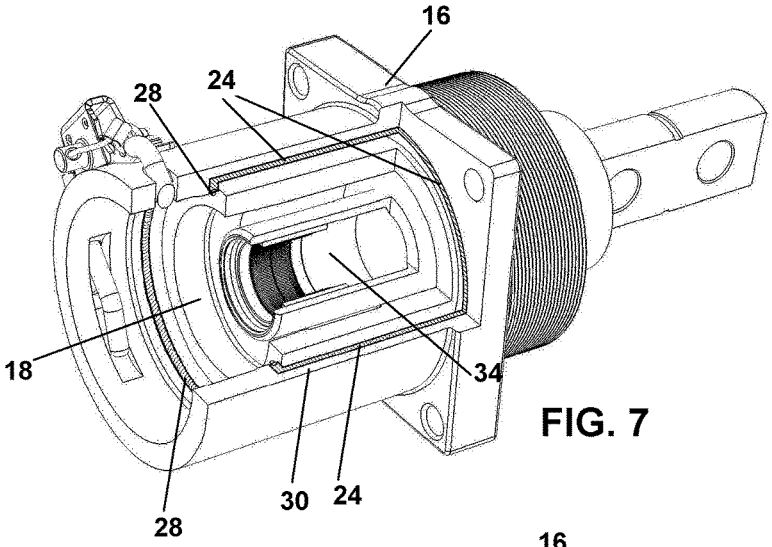
FIG. 7 shows a depiction of the female connector as employed with a mounted receptacle but as would also be configured as a female connector as in FIG. 1.
Figure 8:
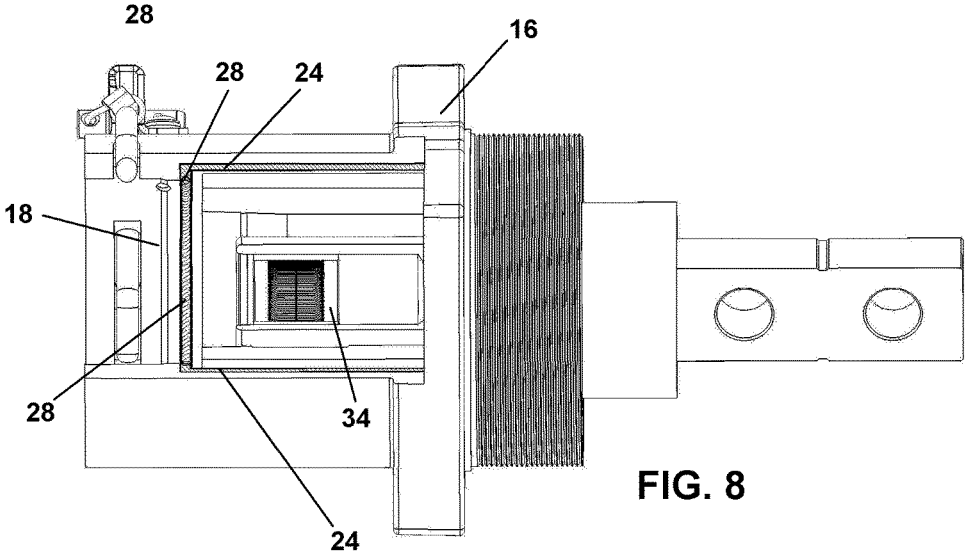
FIG. 8 shows a side view of the connector of FIG. 7.

Also as noted, FIGS. 7 and 8 show sectional views through a second connector or female connector 14 if engaged to a cable 11 or female receptacle 16 if engaged with a panel or fixed position. As can be seen the mating ring 24 is elongated and surrounds the axial cavity 18 from a first end thereof to a second end which is sized for a frictional engagement of the interior of the mating ring 24 with the projecting portion 21 of the elongated ring 20 of the male component 12. Also shown in the preferred placement of a compressible conductive component which will form a biased electrical contact between the projecting portion 21 of the elongated ring 20 and the interior surface of the mating ring 24 at a second end thereof.

It should be noted and anticipated that although the system herein is shown in its most simple form, various components and aspects of the device may be differently shaped or slightly modified when forming the invention herein. As such, those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A shielded electrical connector, comprising:

a first connector having a first end and having a second end;

a center conductor extending axially through said first connector from a first side of said center conductor at or adjacent said first end of said first connector to a second side of said center conductor in an engagement with one end of a cable running axially through said first connector and exiting at said second end thereof;

said first connector slidably positionable to an inserted position where said first end of said first connector is located within a axial cavity of a second connector, to thereby operatively connect said center conductor with an electric charged contact communicating into said axial cavity of said second connector;

an annular ring having an exterior surface and having a passage running therethrough from a first end to a second end thereof;

said engagement of said second side of said center conductor to said cable and a portion of said cable adjacent said engagement to said center conductor, being positioned within said passage which is surrounded by said annular ring;

a first portion of dielectric insulating material positioned in-between said annular ring and said engagement of said second side of said center conductor to said cable and said portion of said cable adjacent said engagement to said center conductor;

a second portion of dielectric insulating material surrounding said exterior surface of said annular ring;

an annular projecting ring extending from said first end of said annular ring, a surface of said annular projecting ring extending from said second portion of said dielectric insulating material; and said annular projecting ring positionable to a contact with a grounded mating connecter located in said axial cavity by positioning said first connector to said inserted position, whereby said annular ring forms a shield preventing RF or EMF from exiting said axial cavity.

2. The shielded electrical connector of claim 1, additionally comprising:

said surface of said annular projecting ring extending circumferentially from said second portion of dielectric insulating material completely around an exterior surface thereof.

3. The shielded electrical connector of claim 1, additionally comprising:

a mating ring positioned in dielectric insulating material surrounding said axial cavity of said second connector; and a projecting ring extending from said mating ring to a projecting portion thereof which extends into said axial cavity forming said grounded mating connecter.

4. The shielded electrical connector of claim 2, additionally comprising:

a mating ring positioned in dielectric insulating material surrounding said axial cavity of said second connector; and a projecting ring extending from said mating ring to a projecting portion thereof which extends into said axial cavity forming said grounded mating connecter.

5. The shielded electrical connector of claim 3, additionally comprising:

said projecting ring portion extending circumferentially completely around said axial cavity.

6. The shielded electrical connector of claim 4, additionally comprising:

said projecting ring portion extending circumferentially completely around said axial cavity.

7. The shielded electrical connector of claim 5, additionally comprising:

a resilient conductor engaged upon said projecting portion of said projecting ring, said resilient conductor forming said grounded mating connector.

8. The shielded electrical connector of claim 4, additionally comprising:

a resilient conductor engaged upon said projecting portion of said projecting ring, said resilient conductor forming said grounded mating connector.

9. The shielded electrical connector of claim 5, additionally comprising:

a resilient conductor engaged upon said projecting portion of said projecting ring, said resilient conductor forming said grounded mating connector.

10. The shielded electrical connector of claim 6, additionally comprising:

a resilient conductor engaged upon said projecting portion of said projecting ring, said resilient conductor forming said grounded mating connector.

11. The shielded electrical connector of claim 7 wherein said resilient conductor is a spring.

12. The shielded electrical connector of claim 8 wherein said resilient conductor is a spring.

13. The shielded electrical connector of claim 9 wherein said resilient conductor is a spring.

14. The shielded electrical connector of claim 10 wherein said resilient conductor is a spring.

* * * * *